United States Patent [19]

Bozza

[11] Patent Number: 4,509,314

[45] Date of Patent: Apr. 9, 1985

[54] BAND WRAPPING MACHINE FOR THE PACKAGING OF PARCELS OF BOXES OR PRODUCTS

[76] Inventor: Ireneo Bozza, Via Stoppato, 9, Bologna, Italy

[21] Appl. No.: 361,138

[22] Filed: Mar. 24, 1982

[30] Foreign Application Priority Data

Jul. 17, 1981 [IT] Italy ..... 3483 A/81

[51] Int. Cl.[3] ..... B65B 11/08; B65B 13/22

[52] U.S. Cl. ..... 53/586; 53/228; 53/229

[58] Field of Search ..... 53/556, 586, 228, 229, 53/230

[56] References Cited

U.S. PATENT DOCUMENTS

| | | | |
|---|---|---|---|
| 3,164,937 | 1/1965 | Ingram | 53/229 |
| 3,564,810 | 2/1971 | Faletti | 53/586 X |
| 3,564,815 | 2/1971 | Bescript | 53/586 |
| 3,596,434 | 8/1971 | Zelnick | 53/586 X |
| 3,621,633 | 11/1971 | Law | 53/586 |
| 3,672,116 | 6/1972 | Ingmarson | 53/586 X |
| 3,766,708 | 10/1973 | Kubo | 53/530 |
| 3,842,572 | 10/1974 | Burge | 53/586 |
| 3,866,389 | 2/1975 | Elsner | 53/229 |
| 3,946,539 | 3/1976 | Noack | 53/586 |
| 4,167,841 | 9/1979 | Camp | 53/586 X |
| 4,250,692 | 2/1981 | Uchida | 53/586 X |
| 4,313,288 | 2/1982 | Tassi | 53/229 X |
| 4,319,443 | 3/1982 | Watts, Jr. | 53/229 X |
| 4,413,463 | 11/1983 | Lancaster | 53/586 X |

FOREIGN PATENT DOCUMENTS

| | | | |
|---|---|---|---|
| 2836552 | 3/1980 | Fed. Rep. of Germany | 53/586 |
| 2948662 | 6/1981 | Fed. Rep. of Germany | 53/556 |
| 995029 | 6/1965 | United Kingdom | 53/586 |
| 1384450 | 2/1975 | United Kingdom | 53/229 |

*Primary Examiner*—John Sipos

*Attorney, Agent, or Firm*—Darby & Darby

[57] ABSTRACT

Disclosed herein is a band wrapping machine which, using one web of heat-sealing material, attends to the packaging of a plurality of boxes or products. The machine is equipped with one roll of the said material that is placed above the horizontal packaging surface and extends vertically up to and across a first horizontal roller positioned beneath the said surface, the axis of this being parallel to that of the said roll and parallel to the devices for cutting and welding the web, that is to say, perpendicular to the horizontal direction in which the parcels of boxes are infed, the said first roller being movable vertically under the action of the pull exerted by the web since this, downstream of the said first roller, is inserted in between a pair of drive rollers that are only able to move in the direction through which the web is unwound from the roll.

8 Claims, 8 Drawing Figures

BAND WRAPPING MACHINE FOR THE PACKAGING OF PARCELS OF BOXES OR PRODUCTS

BACKGROUND OF THE INVENTION

The invention relates to a machine which, through external sealing means constituted by a web, preferably of heat-sealing plastic material tightly enveloping the package, is able to band wrap a plurality of boxes or products grouped into parcels.

DESCRIPTION OF THE PRIOR ART

Basically machines of the aforementioned type can be split into two categories: those that utilize two reels of wrapping material, and those that utilize one single reel. The former type of machine comprises a horizontal surface along which the parcel of products slides and is packaged, this having in it a first transverse slit through which the wrapping material unwound vertically and perpendicularly to the said surface, is made to pass, and a second transverse slit, downstream with respect to the one previously mentioned, through which, from the bottom, operate the devices for cutting and welding the web once the band wrapping of the package has been brought to an end. The two reels of wrapping material are placed, one above and the other below the said surface, with the axes of rotation thereof parallel to the direction of the said slits, the two webs being butt welded one to the other. This is because the web needs to be supplied, at the time the package is made to move forward on the said surface against the wrapping material, both to the upper and to the lower part of the product, and to be unwound from the corresponding reels in view of the fact that, for reasons of friction, no sliding motion can take place between the wrapping material and the product.

The use of two reels, however, leads to the problem that, inevitably, while the machine is running, one reel, due to irregular and differing requirements for wrapping material from the two reels, is exhausted before the other, thereby making it necessary to halt, with a consequent waste of time, the machine at successive stages in order to fit new reels, or alternatively, so as to recover lost time, to replace both reels contemporaneously, despite one not having been completely used up, which is wasteful from the point of view of the wrapping material. Additionally, with new reels, time has to be devoted to the operation of welding the end of one web to the end of the other.

Furthermore, with the said solution the web is subjected, once it has been enshrouded around the package, to two welds, the first of which at a point corresponding to one edge on the parcel of products or boxes, in order to seal the "fastening", and the second slightly downstream of the former so as to allow the web to be cut in between the two welds and the continuous conformation thereof to be maintained ready for the next band wrapping operation.

With the said procedure, however, the second weld in respect of the previous package is inevitably present on the next package which, in this way, will have two welding lines and, as a consequence of this will suffer from the point of view of aesthetics.

The second type of machine utilizes, instead, as stated, one single web of wrapping material that is placed above the sliding surface and from which is unwound a certain length of material, this being subsequently cut into a piece that is intercepted by the package to be fastened, in such a way as to envelop it on three sides.

Subsequently, folder members come into operation and attend to the folding of the free ends of the said piece of wrapping material onto the non-enshrouded side of the package, one on top of the other, after which the operation takes place of welding, not in the butt fashion but superposed, the said two ends.

The problem arises, however, with this type of machine that the band around the package tends to be insufficiently taut.

SUMMARY OF THE INVENTION

The essential object of the invention is to overcome the aforementioned difficulties through the provision of a band wrapping machine that uses the welding system adopted by the machines of the first of the aforementioned types, though with one single reel, or roll, of wrapping material, thereby allowing the replacement of the reel to be made more simple and less time and wrapping material to be wasted, in addition to the fact that the wrapping around the package is formed with one single welding line thereon, with all this being achieved through a solution that is extremely simple and economical, above all in relation to the results attainable therewith.

This and other objects too are all attained by the machine in question comprising a horizontal surface on which the products or boxes slide in parcel form under the action of corresponding thrust means from a packaging position to a position where fastening takes place using a heat-sealing material web that is placed vertically to the said surface and passes through a first slit made transversely with respect to the action direction of the aforementioned thrust means, the said surface having in it, furthermore, a second slit, parallel to the one to which reference has just been made, placed downstream of this with respect to the forward movement direction of the said thrust means, through which, from the bottom, operate the devices for welding and cutting the web once the wrapping of the package has been completed; a reel of the said wrapping material, placed above the said surface and rotating idly around a horizontal axis parallel to the said slits, the said web passing through the said first slit; a first roller, located beneath the said surface parallel to the said slits, around which is wound, in the region of the lower generatrices and at an angle close to one half angle turn, the said web, the said roller being movable vertically and freely along corresponding bilateral guide means, between two extreme positions, namely an extreme upper position with the said web in the parcel enshrounding position, and an extreme lower position for taking up and unwinding the wrapping material from the reel; and a device for locking the web issuing from the said first roller, placed underneath the said horizontal surface at a height in between this and the said first roller, the said device undergoing a brief rotation in one direction only each time the web is unwound from the reel, following the return of the said first roller to the extreme lower position.

In one preferred form of embodiment, the said locking device is constituted by a pair of rubber faced rollers, one tangent to the other, in between which the said web is made to pass, the said rollers being discontinuously driven in one single direction under the action of a free wheel mechanism.

BRIEF DESCRIPTION OF THE DRAWINGS

Further characteristics and advantages of the machine according to the invention will become more apparent from the detailed description that follows of one preferred form of embodiment, illustrated purely as an unlimited example on the accompanying drawings, in which.

DESCRIPTION OF THE PREFERRED EMBODIMENT

Figure 1:
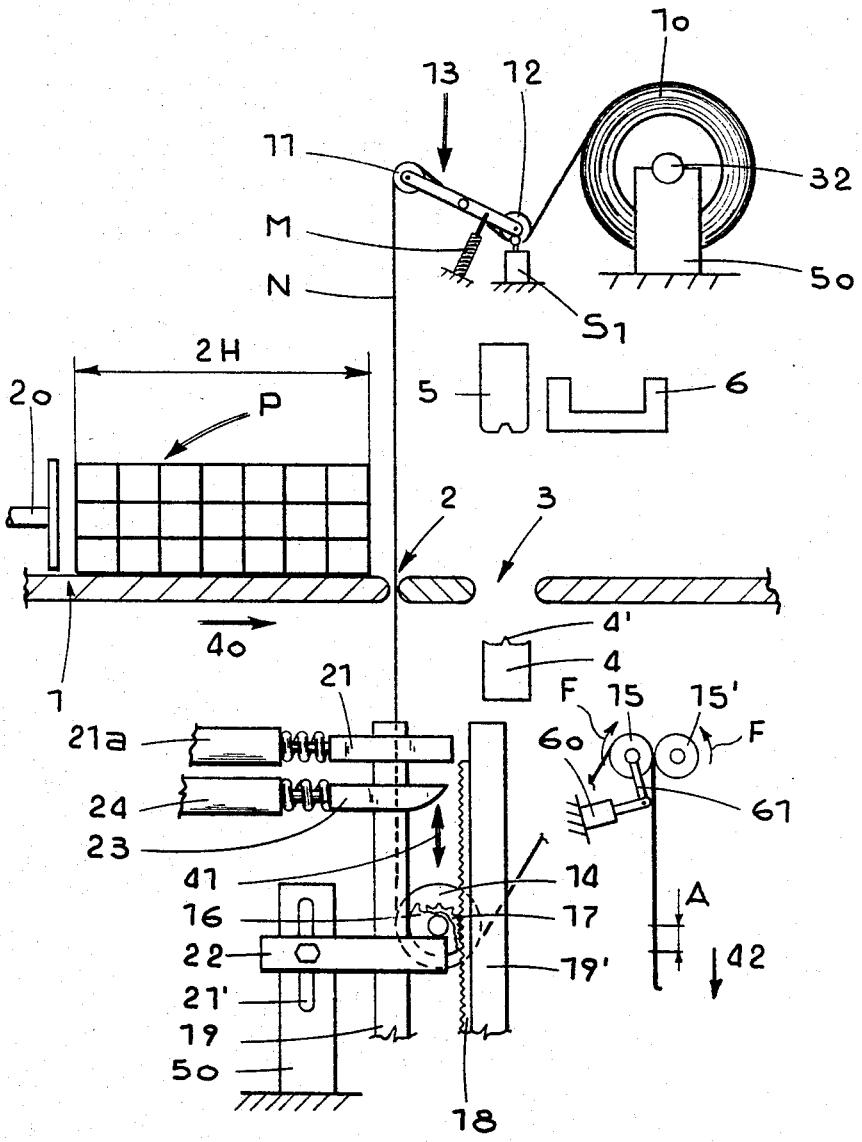
FIG. 1 shows, in a lateral diagrammatic view, the band wrapping machine in question equipped with one single web of wrapping material, with the operating parts thereof positioned ready for the commencing cycle of the machine.

With reference, in particular, to FIG. 1, the machine in question essentially comprises a horizontal surface 1 that constitutes the platform on which are formed, using devices in themselves known and not described herein since they are part and parcel of conventional machines and technology, parcels P of boxes or products arranged in various rows. The said surface constitutes, moreover, the surface on which the said parcels slide from a parcel forming position, illustrated in FIG. 1, to a position where they are banded with the web of wrapping material belonging to the machine in question, illustrated in FIG. 3, the said extreme positions being determined and defined through the operation of thrust means shown globally at 20 in FIG. 2.

The said surface 1 is broken transversely, that is to say, in the direction perpendicular to that of the surface as shown in the drawings, by two slits, 2 and 3, respectively, which thus extend in a direction perpendicular to the direction in which the parcels of products move forward, shown at 40.

The first of the said slits, that is to say the one numbered 2, has the task of allowing the passage there through of a web N of a width, measured in a crosswise direction, or in other words perpendicularly to the sheet, compatible with the dimensions of the parcel P measured along the same direction. The said web, preferably made of a heat-sealing plastic material, is unwound from the reel thereof 10 which is located above the surface 1, idling rotatably around a corresponding spindle 32 carried by the base frame 50 of the machine, to which is also secured the said horizontal surface 1.

Immediately downstream of the reel 10, the said web N is wound around two rollers, 11 and 12, respectively, that idle around the spindles thereof, the latter belonging to a rocker element 13 fastened bilaterally, this also in an idle fashion, to the aforementioned frame 50 which actuates, in the non-pull condition on the part of the web N and under the action of a spring M, a sensor $S_1$ which, when intercepted as seen in FIG. 1, causes the operation of a brake assembly, shown globally at 30, fixed to the spindle 32 that supports the said reel 10, which has the task, when actuated, of locking the unwinding of the web N.

The second transverse slit 3, parallel to the slit 2, is placed downstream of this with respect to the forward movement direction 40 of the parcels P and the purpose thereof is to allow an underneath device for welding and cutting the web, shown globally at 4, to pass through the said surface 1 and to go against an overhead element or counter-plate 5 which is movable vertically together with the device 4, the task of the said welding device and of the said counter-plate being to create two separate welds on the web of material N, one spaced a short distance away from the other, in between which the said web is cut by a blade 4', this being a method that is very well known and is much used on all the band wrapping machines known to date.

At 6 has been shown a presser element, this also movable vertically under the action of appropriate control means, the task of which is, as will be seen better below, to allow and to keep the parcel P stably in position while the final wrapping and sealing operation of the web N onto the said parcel P is taking place.

The said web, after having passed across the surface 1 through the said slit 2, reaches a level below the said surface where it is wound, as can be seen in FIG. 1, firstly around a roller 14, along the lower generatrices thereof over a span close on 180°, and is then inserted and locked through a pair of rollers 15 and 15' that constitute the web locking device.

The said roller 14, or first roller, constitutes a device that can be called a "web storage device", and it is movable vertically along corresponding guides 19 and 19' over which slide bearings 16 forced bilaterally onto the spindle 16' of the said roller 14, the latter being loosely mounted on the said spindle.

To the said spindle 16' are also keyed bilaterally, two gearwheels 17 which are maintained in constant mesh with corresponding flat racks 18 fixed at the sides of the roller, for example to the fixed guide 19', this obviously being to allow the roller 14 to move vertically in the two directions, with the said movement being kept perfectly horizontal and constantly parallel to the overhead surface 1.

The said vertical movement of the roller 14 in the direction shown at 41 in FIG. 1, can be set by two limit elements 21 and 22, namely an upper element and a lower element, the position of the latter being adjustable along a corresponding slot 21' in the frame 50, in such a way as to define two extreme positions for the roller 14, that is to say an extreme upper and an extreme lower position, more about which will be said below.

In the region of the extreme upper position, namely with the spindle 16' flush up against the element 21, the roller 14 is held there by a latch 23, movable horizontally in the two directions shown at **40*a*, integral for example with the keeper of an electromagnet 24. The upper limit element 21 is also movable horizontally in the two directions shown at 40*a*, under the action of control means 21*a*, in such a way as to free the top of the roller 14**, as will be seen better below.

The two rollers 15 and 15' which, as stated, constitute the device for locking and taking up the web N, as will be seen better below, are constituted by two rubber faced rollers, one tangent to the other, integral with the frame 50, which do not move like the said roller 14 but are provided with rotation motion in one single direction, one in the reverse direction to the other, as shown by the arrows F in FIG. 1, by a free wheel device operated by an arm 61 provided with actuating means 60, for example, a pneumatic cylinder or an electromagnet.

The operation of the said cylinder thus causes the roller 15 to rotate clockwise by a predetermined amount established by the stroke of the said piston 60 and this, because of the tangency mentioned above between the two rollers 15 and 15', brings about a rotation to the same extent of the second of the said rollers, namely roller 15', counterclockwise, in such a way as to "fetch" the web N down by an amount A in the direction of the arrow 42 (see FIG. 1), while the movement in the opposite direction of the said web is prevented by the aforementioned free wheel connection of the rollers 15 and 15'.

Figure 8:
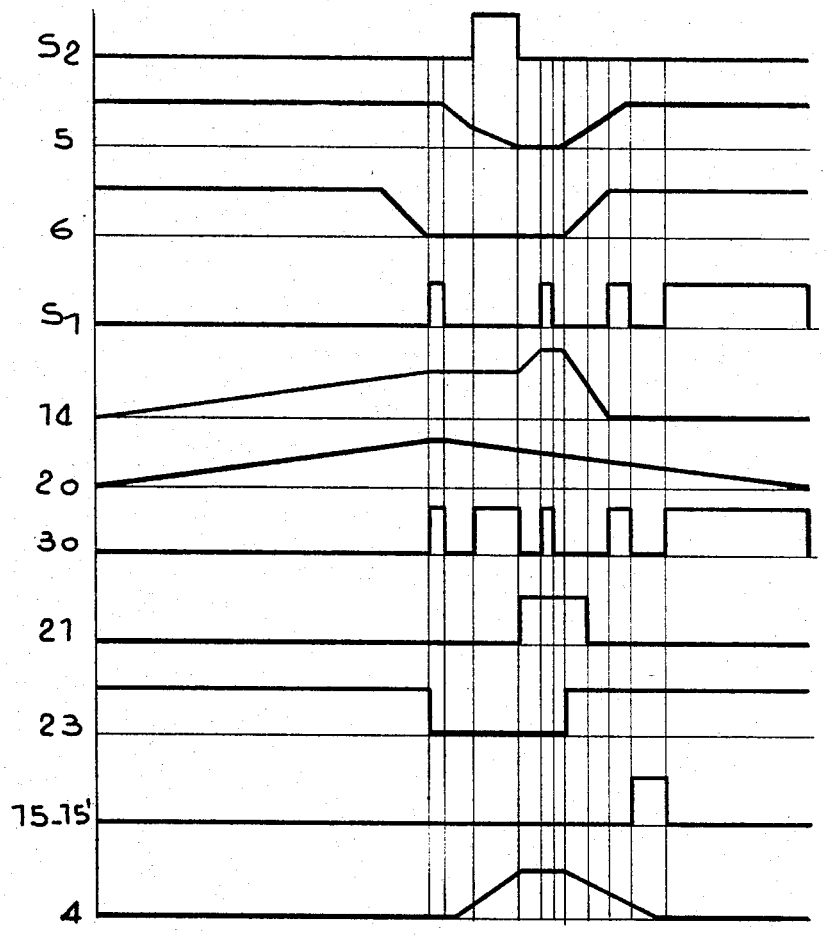
FIG. 8 shows, in a diagrammatic view, the graph of the operations, one with respect to the other.

With the aid of the accompanying figures, a brief description will now be given of the operation of the machine forming the subject of the invention during an operating sequence that leads to the packaging of products or boxes in prearranged parcels P. For this, use will also be made of FIG. 8 which shows indicatively a graph of the various operations, one in relation to the other, each bearing the reference number ascribed thereto, with the value indicated on the ordinate of the displacement, actuation or otherwise of the device or of the sensor.

A commencement will be made at the configuration shown in FIG. 1 which is assumed to correspond to the beginning of the cycle where the web is unwound from the idle reel 10, is made to pass first of all around the rollers 12 and 11 of the rocker element 13, is then inserted across the first slit 2, is then made to pass underneath the roller 14, and finally is locked in between the rollers 15 and 15' after having been inserted there between.

At this juncture, under the action of thrust means 20, the parcel P is infed, pushed in the direction shown at 40, along the top of the surface 1. Intercepting the said movement of the parcel P, the web N starts (see FIG. 2) to enshroud the said parcel P as it is unwound, at the top, from the reel 10 which, since the sensor $S_1$ has not been tripped and is not causing the brake assembly to operate, is free to rotate. Lower down the web N is taken up because of the raising of the roller 14, this exerting on the said web an action on account of the weight of the roller which, as stated earlier on, is movable vertically along the guides 19 and 19'.

Figure 2:
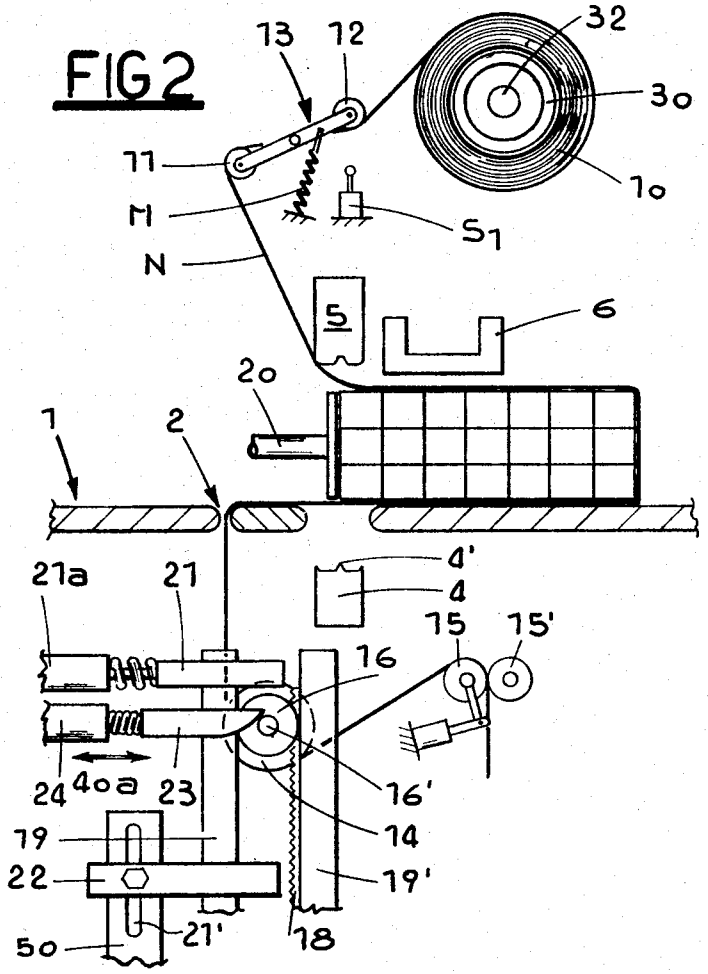

The weight of the roller 14 on one hand, and the unwinding pressure of the web on the other, contribute in applying a certain tension of the said web N on the parcel at the time the latter is being thrust along, as depicted in FIG. 2.

This vertical movement of the roller 14, which in some way clarifies the definition "web storage device", is absolutely necessary because of the web N, underneath the surface 1, not being able to be withdrawn from the locking rollers 15 and 15'.

Figure 3:
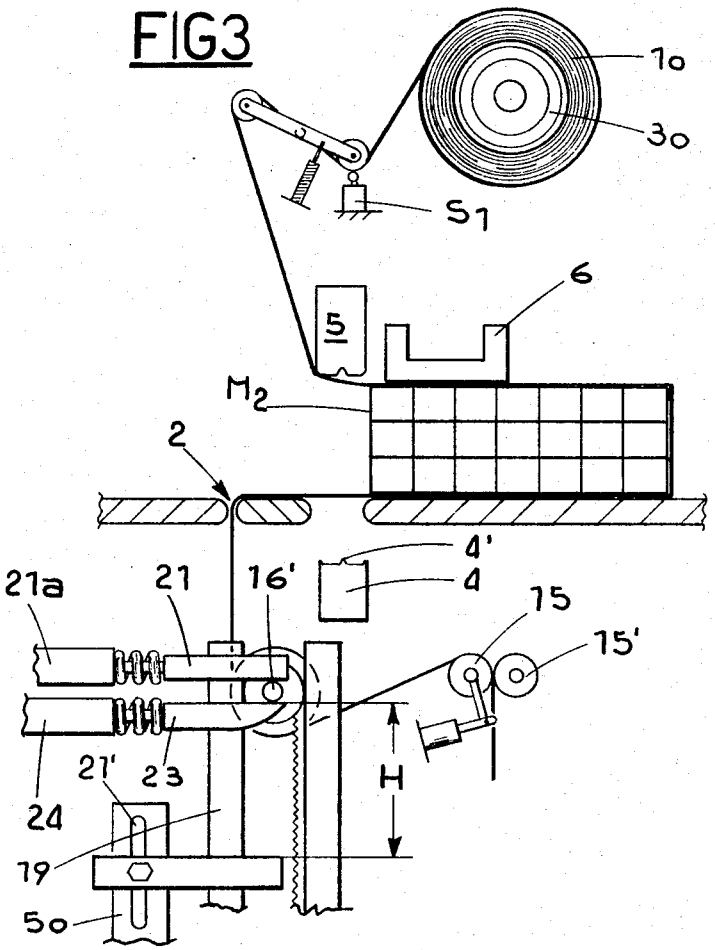
FIGS. 2, 3, 4, 5, 6 and 7 show, again diagrammatically, the succession of operations on the machine in question that lead to the packaging of boxes or products with the use of one web of wrapping material.

When the thrust means 20 have attended to the pushing of the parcel P up to the final position illustrated in FIG. 3, by rotating clockwise, the rocker element 13 returns to the position as per FIG. 1, trips the sensor $S_1$ and thus blocks the rotation of the reel 10. At the same time, the presser element 6 moves downwards to lock the parcel in position, while the underneath roller 14 arrives flush up against the limit element 21 in the interception position and is kept there by the underneath latch 23, placed in the supporting position and on which the said spindle 16' rests. The roller 14 undergoes vertical motion over a distance H equal, at the machine rating, to half the distance 2H corresponding to the length of the parcel. At this time, by suitably adjusting the position of the upper limit element 21, the movement of the roller 14 can be so governed as to create an initial controlled tension on the web N while the parcel P is moving.

Figure 4:
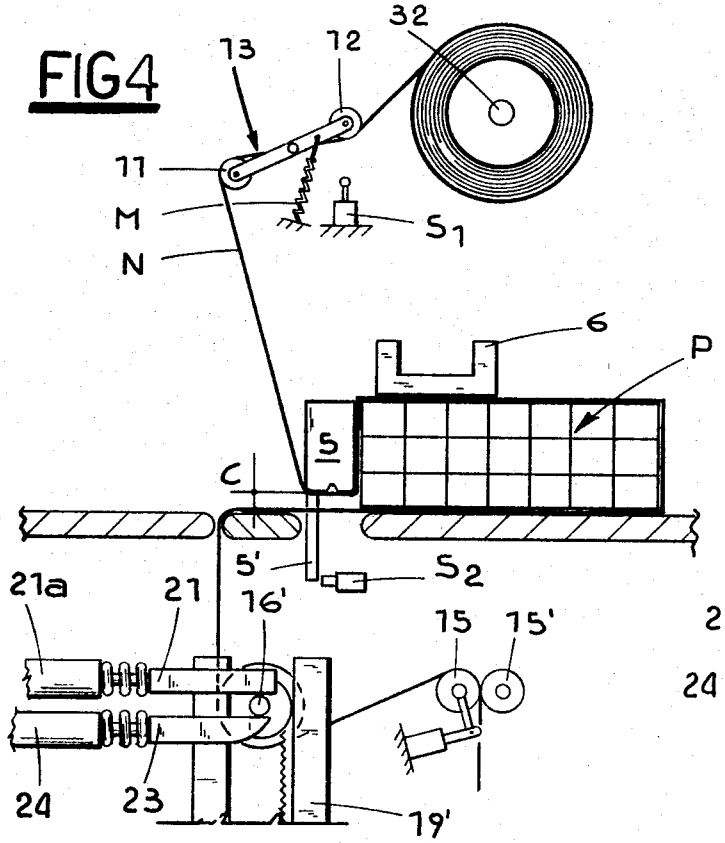

At this juncture, through, for example, a kinematic chain to which all the operating elements of the machine in question are linked, or through a logical sequence controlled by operating means, come into action, from the bottom, the device for welding and cutting the web 4, and from the top, the corresponding counter-plate 5, the latter commencing the vertical downward movement in such a way as to raise the rocker element 13 from sensor S1 and to carry the web N in contact with the last wall $M_2$ not yet enshrouded by the said web N. When the counter-plate 5 has reached (see FIG. 4), after having fetched, during the said movement, a corresponding quantity of wrapping material, a distance from the underneath surface 1 equivalent to a small predetermined value C, the said counter-plate through, for example, a tail piece 5', trips a second sensor $S_2$ which, similarly to the previously mentioned sensor $S_1$, brings about the actuation of the brake assembly 30 with the consequent locking of the rotation of the reel 10, and this causes a further stretching of the web during the subsequent downward travel of the counter-plate 5 in such a way as to improve still further the tautness of the wrapping material around the parcel P.

Figure 5:
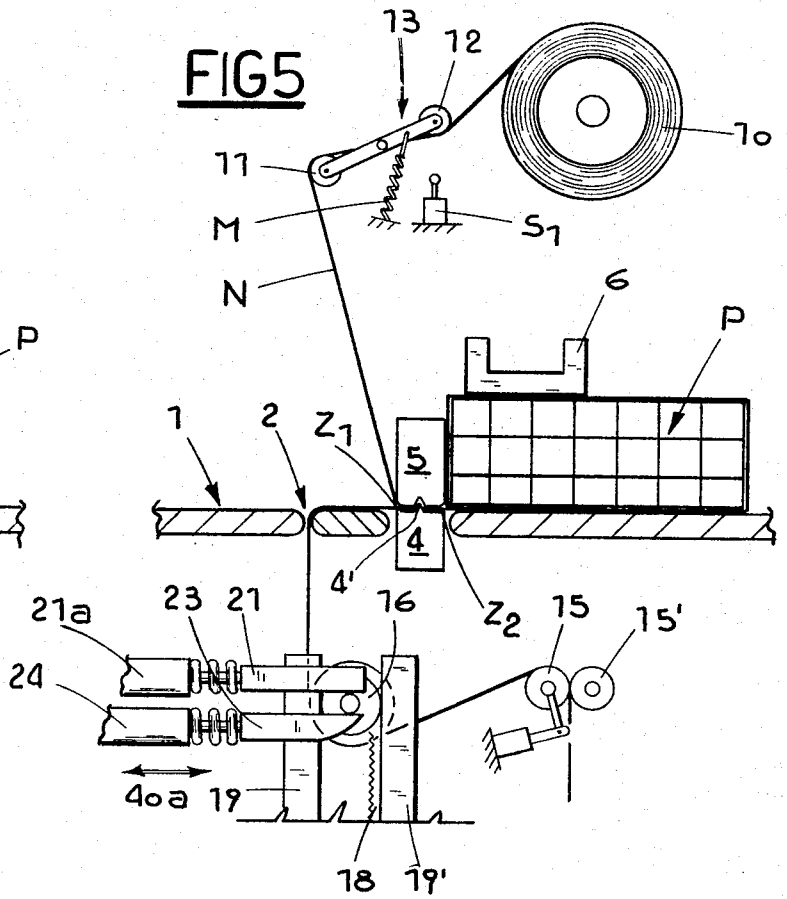

Once the counter-plate 5 has moved right down and has arrived at a position coplanar with the underneath surface (see FIG. 5), the device 4 attends, from the bottom, to the welding of the web N, or rather to the welding of the two superposed pieces of the web N, at two points, namely $Z_1$ and $Z_2$, while the said cutting device 4' looks after the cutting of the web in the space existing between the said welding points, which obviously extend perpendicularly to the surface as shown in the figures, over the full width of the web N.

With the welding of the web around the parcel and the contemporaneous cutting thereof, the release is achieved of the web welded at $Z_1$ from the web welded at $Z_2$ enshrouding the said parcel, and the latter is then removed since the packaging has been completed.

At this point, in order to prevent the tension applied previously to the web N from having an effect on the making of the weld $Z_1$, through the said kinematic chain (or the said operating means), at the top, the deblocking is caused of the brake 30, and at the bottom, the retraction is occasioned of the limit element 21 which frees the roller 14, thereby giving it the possibility to move upwards under the action of the elasticity of the web N, in such a way as to discharge the said elasticity and, in this way, ensure the stability of the weld $Z_1$ and the continuation of the cycle.

Figure 7:
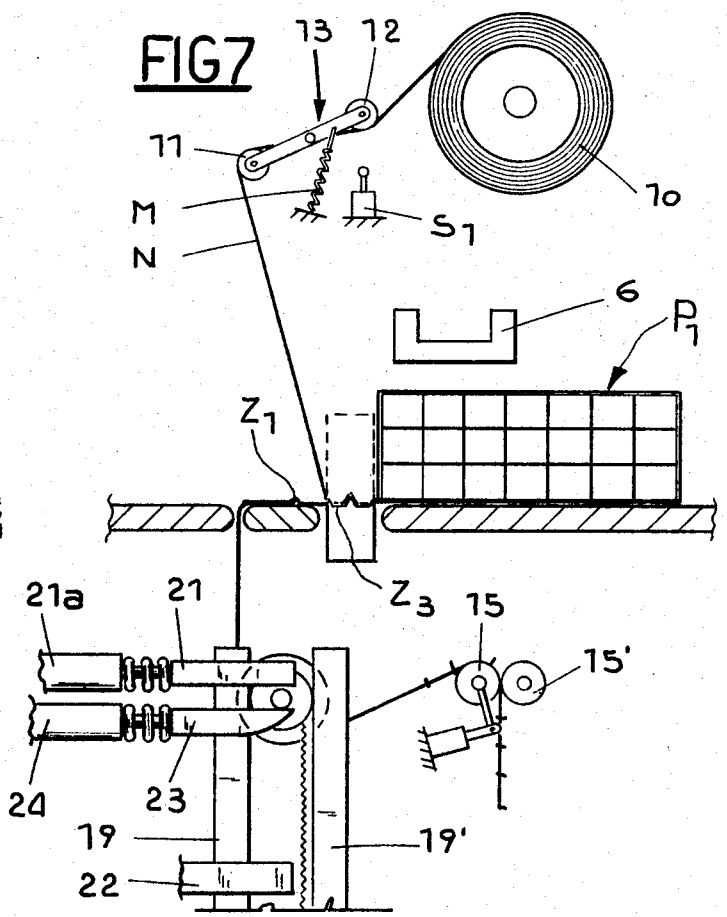
Figure 6:
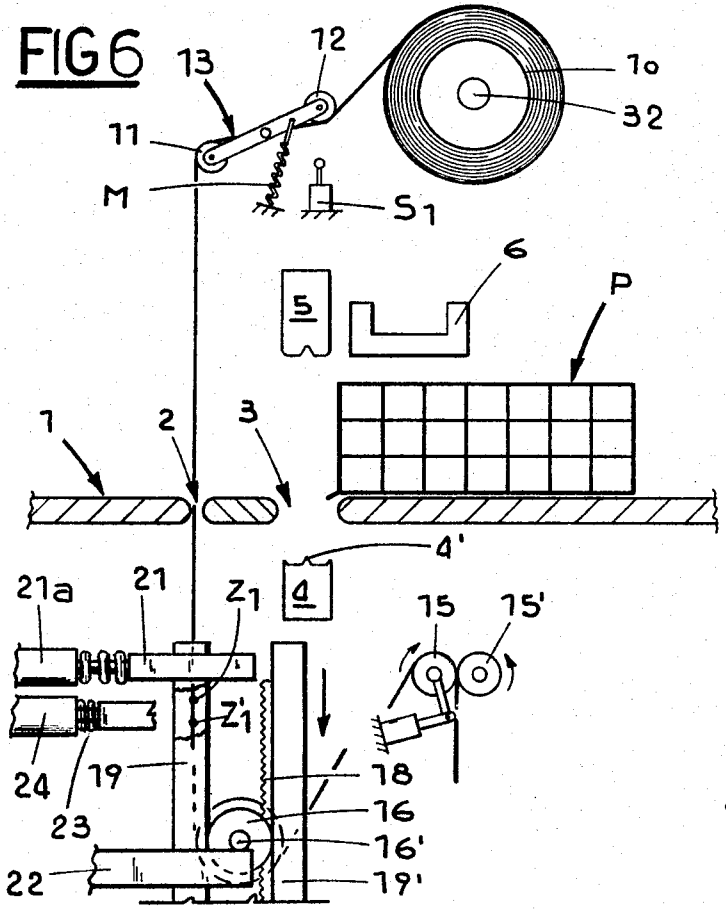

At this juncture, the counter-plate 5 starts to return upwards, freeing the web and releasing sensor 52 and reel 10, and contemporaneously, under the returning action on the part of the electromagnet 24, the release is brought about of the latch 23. In consequence of this, the roller 14 drops downwards by gravity until it arrives at the extreme lower position depicted in FIG. 6, taking with it a quantity 2H of wrapping material, in such a way that the weld $Z_1$ will be positioned as ilustrated in FIG. 6, namely a little above the said roller 14. Once the roller 14 has reached the said lower position, through the said kinematic chain or operating means the excitation occurs of the actuating means 60 so as to bring about sufficient a rotation of the rollers 15 and 15' in the previously illustrated direction to fetch a quantity A of wrapping material from the reel 10 and, in this way, to position the weld $Z_1$ at a lower level shown at $Z'_1$ again in FIG. 6. Although the quantity A is of an extremely limited value it is, however, sufficient to place in the subsequent movement stage of the parcel $P_1$, as illustrated in FIG. 7, the original weld $Z_1$ slightly upstream with respect to the subsequent welding stage $Z_3$ which will be created because of the packaging of the further parcel $P_1$. In this way, the welds $Z_1$, $Z_3$ . . . $Z_n$, through the aforementioned system utilizing the roller 14 and the rollers 15 and 15', are all arranged along the web underneath the surface 1 without in the slightest affecting the subsequent operations of fastening or packaging the parcels, the said welds being eliminated as waste downstream of the rollers 15 and 15'.

It is, moreover, obvious just how the use of the above mentioned roller 14, which acts in this way as a "web storage device", makes it possible to package the parcels with the use of one single reel of wrapping material 10, since the said roller 14, because of the vertical movement made, enables first of all the underneath part of the parcel P to be enshrouded by the web and then the latter to be taken up through an unwinding operation of the reel 10, at the time of the vertical downward travel of the roller 14 from the extreme upper to the extreme lower position, while the movement action of the rollers 15 and 15' has solely the purpose, as stated previously, of allowing the web to recede so as to carry the weld that remains on the web into a position that does not affect the next packaging operation.

Moreover, it is quite obvious that through the action of braking the reel 10 at the time the web is being enshrouded around the parcel P, the said web is subjected to an elastic stretching action such as to render the final package more compact.

To conclude, it should be noted that the limit element 22 in respect of the extreme lower position of the said roller 14 can, by sliding it along the said slot 21', be set at different levels to suit the vertical displacement H the said roller has to effect, that is to say, in keeping with the length 2H of the said parcel P.

In the practical form of embodiment, the machine according to the invention can also adopt forms that differ from the foregoing description and, in particular, numerous modifications of a practical nature may be made without there being any deviation from the framework of protection afforded to the invention.

What is claimed is:

1. Band wrapping machine for the packaging of parcels of boxes or products, comprising in combination:

thrust means for sliding the parcels across a horizontal surface from a packaging position to a fastening position in which they are fastened by a heat-sealing material web initially extending vertically with respect to said surface and passing through a first transverse slit;

an operating device for welding and cutting the web once the wrapping of the package has been completed to form a seal on the wrapped package and on the vertically extending film, said operating device acting through a second slit parallel to said first one and placed downstream thereof;

a reel of said wrapping material, placed above said horizontal surface and rotating around a horizontal axis parallel to the said slits to feed said material in a feeding direction to said first slit;

a web storage roller, located beneath, and parallel to said first slit around which said web is wound, in the region of the lower generatrices and at an angle close to one half circle turn, bilateral guide means, said web storage roller being movable vertically and freely under the influence of gravity along said bilateral guide means, between two extreme positions, namely an extreme upper position with said web tightened and shrouded around the parcel, and an extreme lower position for taking up and unwinding the wrapping material from the reel and downwardly move said seal on the vertically extending film out of the path of the next parcel; and a device for locking the web issuing from the web storage roller and preventing said wrapping material from moving in the direction opposite said feeding direction, means for mounting said device underneath said horizontal surface at a height in between said horizontal surface and said web storage roller when said storage roller is in said lower position, means for actuating said device to move said film in said film feeding direction only each time the web is unwound from the reel, following the return of said web storage roller to the extreme lower position to further downwardly move the seal on the vertically extending film sufficiently so that no seal is present in the film for the next parcel.

2. Machine according to, claim 1 wherein said locking device comprises a pair of rollers, one tangent to the other, in between which the web is made to pass, said rollers being discontinuously driven in one single direction under the action of a free wheel mechanism controlled by corresponding actuating means.

3. Machine according to, claim 1 further comprising, in the region of said reel, an assembly for the braking of the reel and operating means therefor, and downstream of said reel, a rocker element comprising at least two idle rollers parallel to said slits, in between which the web slides, said rocker element being rotatable idly in one direction under the pulling action of said web and in the other direction under the action of elastic means, the machine further comprising first sensor means placed in the region of said rocker element and designed to be intercepted thereby when there is a non-pulling action on the part of the web and, consequently, to cause the actuation of said brake.

4. Machine according to claim 1 wherein said device for welding and cutting the web is placed underneath said horizontal surface, in the region of said second slit, further comprising a counter-plate, positioned above said surface, in the region of said second slit, movable vertically and designed to act as an element for enshrouding the web around the trailing wall of the parcel and as an element against which said welding and cutting device strikes, as well as, in the region of the said reel, a device for the braking thereof, and operating means therefor, and second sensor means, placed along the path of the said counter-plate, designed to detect, when excited, a predetermined vertical downward displacement of the latter and, consequently, to bring about the actuation of the said brake device.

5. Machine according to claim 1 wherein said guide means further comprises a pair of gearwheels connected to said web storage roller at spaced-apart locations thereof and a pair of stationary racks respectively engageable with said gear wheels.

6. Machine according to claim 1 further comprising a pair of limit elements, placed along the path of said web storage roller, that define said extreme upper and lower positions, at least one of said limit elements being adjustable in elevation to adjust the displacement of the said roller.

7. Machine according to claim 6 further comprising engaging and disengaging means operatively associated with said upper limit element so as to limit the upward movement of said web storage roller and free its movement upon completion of the web welding and cutting action on the part of the device concerned.

8. Machine according to claim 7 further comprising latching means for the web storage roller and means for disengagement thereof, said latching means being subject to the action of said means for disengagement thereof so as selectively to free said web storage roller at said extreme upper position.

* * * * *